US007126880B2

(12) United States Patent
Motokawa et al.

(10) Patent No.: US 7,126,880 B2
(45) Date of Patent: Oct. 24, 2006

(54) RADIO WRISTWATCH

(75) Inventors: Daisuke Motokawa, Saitama (JP); Yoshiyuki Hayami, Saitama (JP)

(73) Assignees: Trigger Co. Ltd., Tokyo (JP); Manlei Precision Limited, Hong Kong (CN)

( * ) Notice: Subject to any disclaimer, the term of this patent is extended or adjusted under 35 U.S.C. 154(b) by 104 days.

(21) Appl. No.: 10/433,618

(22) PCT Filed: Jun. 27, 2002

(86) PCT No.: PCT/JP02/06506

§ 371 (c)(1),
(2), (4) Date: Jun. 17, 2003

(87) PCT Pub. No.: WO03/003130

PCT Pub. Date: Jan. 9, 2003

(65) Prior Publication Data

US 2004/0042344 A1 Mar. 4, 2004

(30) Foreign Application Priority Data

Jun. 29, 2001 (JP) ..... 2001-200185
Sep. 4, 2001 (JP) ..... 2001-268081

(51) Int. Cl.
*G04C 11/02* (2006.01)
*G04C 23/02* (2006.01)
*G04B 37/00* (2006.01)

(52) U.S. Cl. ..... 368/47; 368/88

(58) Field of Classification Search ..... 368/47, 368/52, 281, 88
See application file for complete search history.

(56) References Cited

U.S. PATENT DOCUMENTS 5,331,608 A * 7/1994 Umemoto et al. ..... 368/10
5,798,984 A * 8/1998 Koch ..... 368/10
5,946,610 A * 8/1999 Hama ..... 455/351
6,278,873 B1 * 8/2001 Itakura et al. ..... 455/351
6,411,569 B1 * 6/2002 Megner et al. ..... 368/43

FOREIGN PATENT DOCUMENTS

JP 57-132286 8/1982
JP 132286 8/1982

(Continued)

OTHER PUBLICATIONS www.physlink.com/Education/AskExperts/ae546.cfm Feb. 2, 2005.*

*Primary Examiner*—Vit W. Miska
(74) *Attorney, Agent, or Firm*—Westerman, Hattori, Daniels & Adrian, LLP.

(57) ABSTRACT

In a wristwatch case, a nonmetal dial plate (305) is disposed so as to face a transparent window plate (304), and a movement (303) with a built-in antenna is disposed between the nonmetal dial plate (305) and a nonmetal back cover plate (306). A metal annular window frame (301) and/or a metal annular back cover frame (302) has an extension (L1, L2) extending appropriately toward a metal annular base (300). Thereby, in the wristwatch case, the outer periphery of the movement (303) with a built-in antenna disposed between the nonmetal dial plate (305) and the nonmetal back cover plate (306) is surrounded so that the region is divided vertically, by the metal annular base (300) and the extension (L1) of the metal annular window frame (301) and/or the extension (L2) of the metal annular back cover frame (302).

9 Claims, 10 Drawing Sheets

FOREIGN PATENT DOCUMENTS

| | | | |
|---|---|---|---|
| JP | 06-331759 | | 12/1994 |
| JP | 6-331759 | A | 12/1994 |
| JP | 2001-33571 | | 2/2001 |
| JP | 2001-33571 | A | 2/2001 |
| JP | 2001-305244 | | 10/2001 |
| JP | 2002-168978 | | 6/2002 |

* cited by examiner ( a ) PLAN VIEW ( b ) ELEVATION VIEW

RADIO WRISTWATCH

TECHNICAL FIELD

The present invention relates to a radio wave wristwatch with a built-in antenna having a receiving antenna incorporated inside its case. More particularly, it relates to a radio wave wristwatch with a built-in antenna, capable of receiving radio wave time signals with high sensitivity while using a metal case that is less permeable to radio waves.

BACKGROUND ART

In general, most consumers think that a case for a wristwatch is preferably made of metal. Such consumers' taste is often found in people in the middle to high age groups in terms of generation, and in Japan and Europe in terms of region.

For a radio wave wristwatch with a built-in antenna, a radio wave permeating material such as plastics and ceramics are often used as a material for the case. If a metal such as stainless steel is used as the material for the case, radio wave time signals cannot sufficiently penetrate the case, so a normal operation for receiving radio waves cannot be anticipated. If a plastic material is used as the material for the case, purchasers of such radio wave wristwatches with a built-in antenna tend to have a bias toward younger generations mainly because of insufficient sense of luxury in appearance, and the wristwatches of this type actually have poor sales among people in the middle to high age groups. Also, if ceramics is used as the material for the case, sales diminishes due to a high sales price.

On the other hand, in a radio wave wristwatch with an externally mounted antenna, having a receiving antenna disposed on the outside of the case, by accommodating the receiving antenna within a specially designed plastic case, or incorporating it in a leather watchband, the wristwatch case itself containing a movement can be made of metal. However, such radio wave wristwatch with an externally mounted antenna lacks simplicity and smartness in terms of appearance, and the connecting construction between the antenna and the movement becomes complicated, and thereby its sales are not widely spread.

Accordingly, the inventors conducted studies earnestly to develop a radio wave wristwatch with a built-in antenna, capable of receiving radio wave time signals with high sensitivity while using a metal case that is less permeable to radio waves. The process reaching the development is as described below.

FIG. 6 is a sectional view showing a construction of a conventional metal wristwatch case used for an ordinary wristwatch (ordinary wristwatch other than the radio wave wristwatch).

As shown in FIG. 6, this metal wristwatch case 101 is constructed by integrally combining three elements in a lapped manner: the three elements are, a metal annular base 102 for shaping a case contour, a metal annular window frame (generally, referred to as a "bezel" also) 104 positioned on the surface side of the metal annular base 102 to fringe a transparent window plate 103, and a metal back cover 105 positioned on the back surface side of the metal annular base 102.

Inside the metal wristwatch case 101, a metal dial plate 106 is disposed so as to face the transparent window plate 103, and a movement 107 is contained in a space 108 between the metal dial plate 106 and the metal back cover 105.

As the metal annular base 102 shown in the figure, for example, a material SUS304 having a thickness of 4 mm, an inside diameter of 32 mm, and a height D1 of 6 mm is used. Also, for example, a glass material having a thickness of 1 mm and a diameter of 30 mm is used as the transparent window plate 103. Also, for example, a material SUS304 having a thickness of 4 mm, an inside diameter of 28 mm, and a height of 3 mm is used as the metal annular window frame 104. Also, for example, a material SUS304 having a thickness of 2 mm and a diameter of 36 mm is used as the metal back cover 105. Also, for example, a material Bs having a thickness of 0.6 mm and a diameter of 30 mm is used as the metal dial plate 106. Further, for example, an ordinary wristwatch movement having a diameter of 26 mm and a height of 5 mm is used as the movement 107.

If the ordinary wristwatch movement 107 is merely replaced with a movement with a built-in antenna for radio wave wristwatch on the basis of the construction shown in FIG. 6, the movement for the radio wave wristwatch hardly receives radio wave time signals. The reason for this is that the movement for the radio wave wristwatch is completely enclosed by the metal dial plate 106 on the upper side, the metal back cover 105 on the lower side, and the relatively thick metal annular base 102 on the periphery.

Thereupon, the inventors made an attempt to use a dial plate made of a radio wave permeating material (for example, glass or plastics) replacing the metal dial plate 106, and to use a back cover made of a radio wave permeating material (for example, glass or plastics) replacing the metal back cover 105. Thereby, the radio wave time signal reception sensitivity was improved considerably due to the removal of radio wave shielding elements positioned above and below the movement. However, the radio wave time signal reception sensitivity did not reach a level for practical use.

Next, the inventors paid attention to the radio wave shielding elements positioned at the side of the movement 107, and attempted to decrease the thickness of the metal annular base 102. However, since the metal annular base 102 must maintain the strength of the case and hold an operating push button penetrating the metal annular base 102, the decrease in thickness thereof has a limitation. Therefore, although the radio wave time signal reception sensitivity was improved to some degree, it did not yet reach a level for practical use.

The present invention has been made in view of the above-described technical background, and accordingly an object thereof is to realize a radio wave wristwatch having a metallic appearance like the appearance of an ordinary wristwatch, by improving radio wave permeability in the vertical direction and at the side of a movement while the strength and thickness of a metal annular base constituting a case body is kept at a required level.

Another object of the present invention is to provide a radio wave wristwatch having a metallic appearance that can also be manufactured at a low cost.

Other objects and advantages of the present invention will become apparent for a person skilled in the art from the following description.

DISCLOSURE OF THE INVENTION

A radio wave wristwatch in accordance with the present invention has a wristwatch case constructed by integrally combining three elements in a lapped manner: the three elements are, a metal annular base, a metal annular window frame positioned on the surface side of the metal annular base to fringe a transparent window plate, and a metal annular back cover frame positioned on the back surface side of the metal annular base to fringe a nonmetal back cover plate. Herein, the term "annular" used for the metal annular base includes various shapes such as a circular ring shape, square ring shape, and elliptical ring shape. Also, in actuality, the outside shape of annular base generally has a locking element for a watchband, a pushbutton, and the like projecting from the annular base, and thus the term "annular" includes all of these irregular ring shapes.

Inside the wristwatch case, a nonmetal dial plate is disposed so as to face the transparent window plate. Also, a movement with a built-in antenna is disposed between the nonmetal dial plate and the nonmetal back cover plate. The movement with a built-in antenna is, as the person skilled in the art knows well, an assembly constructed by integrally assembling a receiving antenna, a printed circuit board, a battery, a gearbox, and the like necessary for manufacturing the radio wave wristwatch. As the receiving antenna, a ferrite bar antenna formed by winding a coil around a square rod shaped ferrite core is usually used. The movement with a built-in antenna is sometimes contained in a plastic housing having thin walls placed on a thin circular plate. In this case as well, the side of the receiving antenna is often exposed from the housing to improve the reception sensitivity. The height of the movement with a built-in antenna depends on the design concept, but is usually approximately equal to the thickness of the receiving antenna. That is to say, the minimum height of movement is determined by the thickness of a laminated body of the printed circuit board and the gearbox. On the other hand, the thickness of the ferrite bar antenna is preferable to be as thick as possible from the viewpoint of increasing the reception sensitivity by increasing the cross-sectional area of ferrite bar. Therefore, in actuality, the thickness of ferrite bar is designed to coincide with the thickness of the laminated body of the printed circuit board and the gearbox. Hereunder, the height of movement with a built-in antenna should be understood substantially as a synonym for the thickness of the receiving antenna.

The metal annular window frame and/or the metal annular back cover frame has an extension extending in an appropriate length toward the metal annular base.

Herein, the term "and/or" includes three cases: 1) the metal annular window frame is extended downward toward the metal annular base, 2) the metal annular back cover frame is extended upward toward the metal annular base, and 3) the metal annular window frame is extended downward toward the metal annular base, and the metal annular back cover frame is extended upward toward the metal annular base.

Thereby, inside the wristwatch case, the outer periphery of the movement with a built-in antenna disposed between the nonmetal dial plate and the nonmetal back cover plate is surrounded so that the region is divided vertically, by the metal annular base and the extension of metal annular window frame and/or the extension of metal annular back cover frame.

Herein, the phrase "surrounded so that the region is divided vertically" means that, although the entire outer periphery of movement has conventionally been surrounded uniformly without a gap as shown in FIG. 1(*a*), in the present invention, as shown in FIGS. 1(*b*), 1(*c*) and 1(*d*) in a slightly exaggerated manner, a portion surrounded by a metal annular base 300 and a portion surrounded by a lower extension L1 of a metal annular window frame 301 or an upper extension L2 of a metal annular back cover frame 302 are provided therein.

FIG. 1(*a*) shows a construction of the ordinary wristwatch case. In this figure, reference numeral 200 denotes a metal annular base, 201 denotes a metal annular window frame, 202 denotes a metal back cover, 203 denotes an ordinary wristwatch movement, 204 denotes a transparent window plate, and 205 denotes a metal dial plate.

Also, FIGS. 1(*b*), 1(*c*) and 1(*d*) each shows one typical example of a construction of a radio wave wristwatch case in accordance with the present invention. In these figures, reference numeral 300 denotes the metal annular base, 301 denotes the metal annular window frame, 302 denotes the metal annular back cover frame, 303 denotes the radio wave wristwatch movement with a built-in antenna, 304 denotes the transparent window plate, 305 denotes the nonmetal dial plate, 306 denotes the nonmetal back cover plate, L1 denotes a lower extension of the metal annular window frame, and L2 denotes an upper extension of the metal annular back cover frame.

More specifically, as shown in FIGS. 1(*b*), 1(*c*) and 1(*d*), the following three surrounding embodiments can be thought out according to the configuration of the above-described extensions L1 and L2.

A first embodiment is a case where only the metal annular window frame 301 is extended downward to form the lower extension L1 as shown in FIG. 1(*b*). If the height of the whole case remains unchanged, the height of the metal annular base 300 would decrease accordingly. In this case, a lower wide region of the outer periphery of the movement 303 is surrounded by the metal annular base 300, and an upper narrow region thereof is surrounded by the lower extension L1 of the metal annular window frame 301.

A second embodiment is a case where only the metal annular back cover frame 302 is extended upward to form the upper extension L2 as shown in FIG. 1(*d*). In this example as well, if the height of the whole case remains unchanged, the height of the metal annular base 300 would decrease accordingly. In this case, an upper wide region of the outer periphery of the movement 303 is surrounded by the metal annular base 300, and a lower narrow region thereof is surrounded by the upper extension L2 of the metal annular back cover frame 302.

A third embodiment is a case where not only the metal annular window frame 301 is extended downward to form the lower extension L1, but also the metal annular back cover frame 302 is extended upward to form the upper extension L2 as shown in FIG. 1(*c*). In this example as well, if the height of the whole case remains unchanged, the height of the metal annular base 300 would decrease accordingly. In this case, a middle wide region of the outer periphery of the movement 303 is surrounded by the metal annular base 300, an upper narrow region thereof is surrounded by the lower extension L1 of the metal annular window frame 301, and a lower narrow region thereof is surrounded by the upper extension L2 of the metal annular back cover frame 302.

The radio wave wristwatch in accordance with the present invention viewed from another viewpoint has a wristwatch case constructed by integrally combining three elements in a lapped manner: the three elements are, the metal annular base 300, the metal annular window frame positioned on the surface side of the metal annular base 300 to fringe a transparent window plate 304, and the metal annular back cover frame 302 positioned on the back surface side of the metal annular base 300 to fringe the nonmetal back cover plate 306.

Inside the wristwatch case, the nonmetal dial plate 305 is disposed so as to face the transparent window plate 304, and the movement 303 with a built-in antenna is disposed between the nonmetal dial plate 305 and the nonmetal back cover plate 306.

The dimensional relationship between the metal annular base 300 and the movement 303 with a built-in antenna is determined so that a height D1 (see FIG. 2) of the metal annular base 300 is smaller than a height D2 (see FIG. 2) of the movement 303 with a built-in antenna, and the upper and lower outer peripheries of the movement 303 with a built-in antenna projecting vertically from the metal annular base 300 are surrounded by the lower extension L1 of the metal annular window frame 301 and the upper extension L2 of the metal annular back cover frame 302.

Herein, the required thicknesses are compared regarding the metal annular base 300 shaping a case contour, the lower extension L1 of the metal annular window frame 301 positioned on the surface side of the metal annular base 300, and the upper extension L2 of the metal annular back cover frame 302 positioned on the back surface side thereof. It is difficult to greatly decrease the thickness of the metal annular base 300 because the metal annular base 300 maintains the strength of the wristwatch case, and the operating button penetrates the metal annular base 300. Whereas, the thicknesses of the lower extension L1 of the metal annular window frame 301 and the upper extension L2 of the metal annular back cover frame 302 can be decreased considerably because these extensions L1 and L2 are not required to have such high strength. Therefore, the thicknesses of these extensions L1 and L2 are decreased appropriately as compared to the thickness of the annular base 300, by which the radio wave permeability as the whole peripheral side of the movement 303 is improved, and thus high enough radio wave time signal reception sensitivity to operate the radio wave wristwatch properly can be achieved.

In a preferred embodiment of the present invention, the material of the metal annular base 300 is a nonmagnetic metal or a feebly magnetic material. As such metal, SUS, Ti, Bs, Al, Ti alloy, Al alloy, etc. are included. According to the above-described configuration, the radio wave permeability is also improved in terms of material property.

In a preferred embodiment of the present invention, the material of the metal annular window frame 301 is a nonmagnetic metal or a feebly magnetic material. As such metal, SUS, Ti, Bs, Al, Ti alloy, Al alloy, etc. are included. According to the above-described configuration, the radio wave permeability is also improved in terms of material property.

In a preferred embodiment of the present invention, the material of the metal annular back cover frame 302 is a nonmagnetic metal or a feebly magnetic material. As such metal, SUS, Ti, Bs, Al, Ti alloy, Al alloy, etc. are included. According to the above-described configuration, the radio wave permeability is also improved in terms of material property.

In a preferred embodiment of the present invention, the material of the nonmetal dial plate 305 is plastics or glass. According to the above-described configuration, radio waves are not shielded by the dial plate.

In a preferred embodiment of the present invention, the material of the nonmetal back cover plate 306 is plastics or glass. According to the above-described configuration, radio waves are not shielded by the back cover plate.

In a preferred embodiment of the present invention, the thickness of the metal annular base 300 is in the range of 2.0 to 3.0 mm, and the thicknesses of the metal annular window frame 301 and the metal annular back cover frame 302 are 0.5 mm or more smaller than the thickness of the metal annular base 300. By this configuration, the radio wave permeability of the metal annular window frame 301 and the metal annular back cover frame 302 can be improved as compared with the metal annular base 300. In addition, in the case of an ordinary wristwatch with an inside diameter of about 30 to 32 mm, if the thickness of the metal (for example, stainless steel made) annular base 300 is 2.0 mm or smaller, a pipe in which a pin for the pushbutton is inserted projects to the inner peripheral side of the base 300, therefore a need arises for increasing the diameter of the base 300 accordingly. Inversely, if the thickness of the metal annular base 300 exceeds 3.0 mm, the receiving operation may be hindered.

In a preferred embodiment of the present invention, a colored film is formed on the inside surface of the nonmetal back cover plate 306. According to this configuration, a sense of luxury can be given to the back cover plate.

In a preferred embodiment of the present invention, the material of the transparent window plate 304 is plastics or glass.

BEST MODE FOR CARRYING OUT THE INVENTION

One preferred embodiment of a radio wave wristwatch in accordance with the present invention will now be described in detail with reference to the accompanying drawings.

Figure 2:
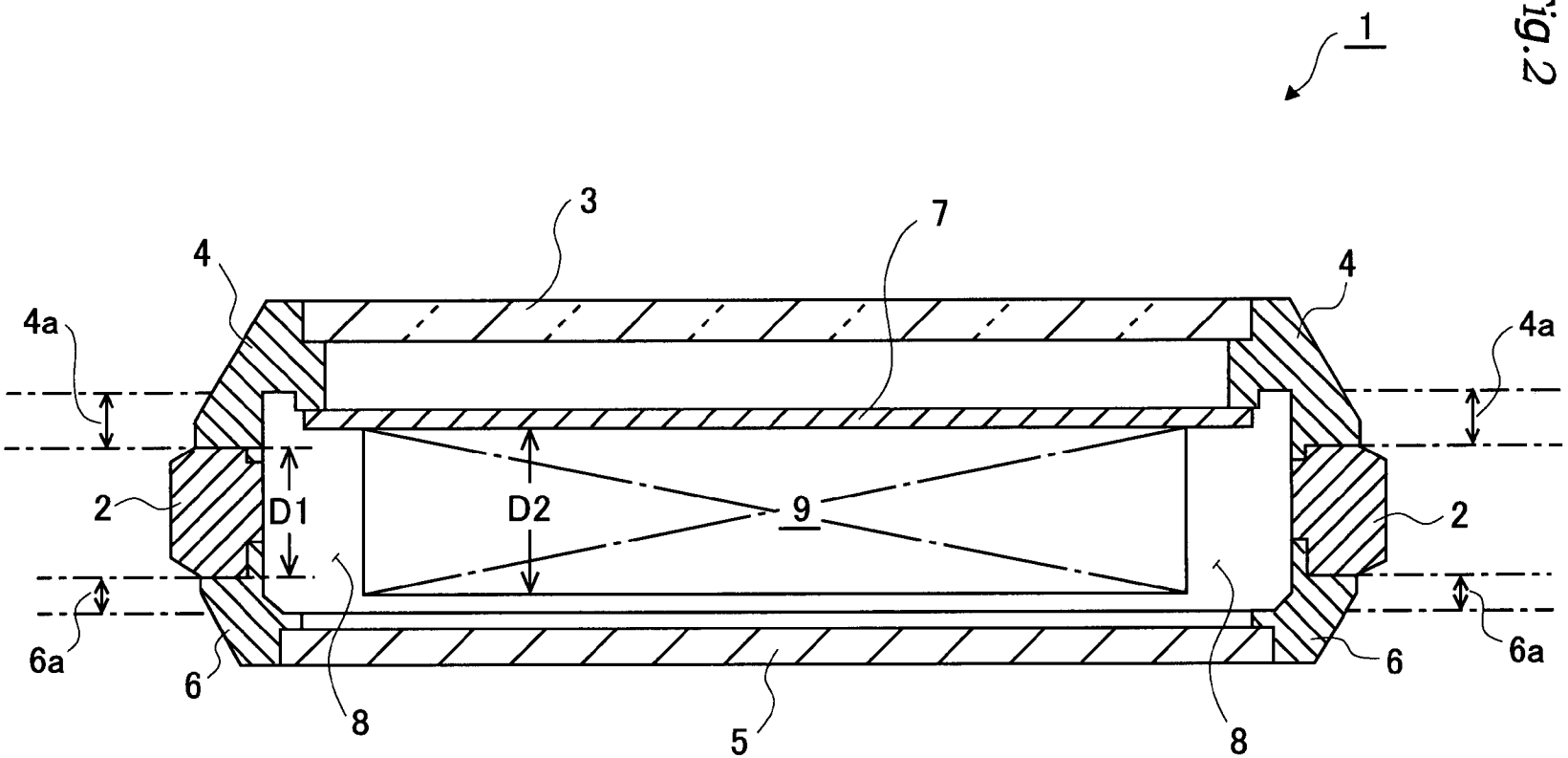
FIG. 2 is a sectional view showing a construction of a metal radio wave wristwatch case in accordance with the present invention.
Figure 3:
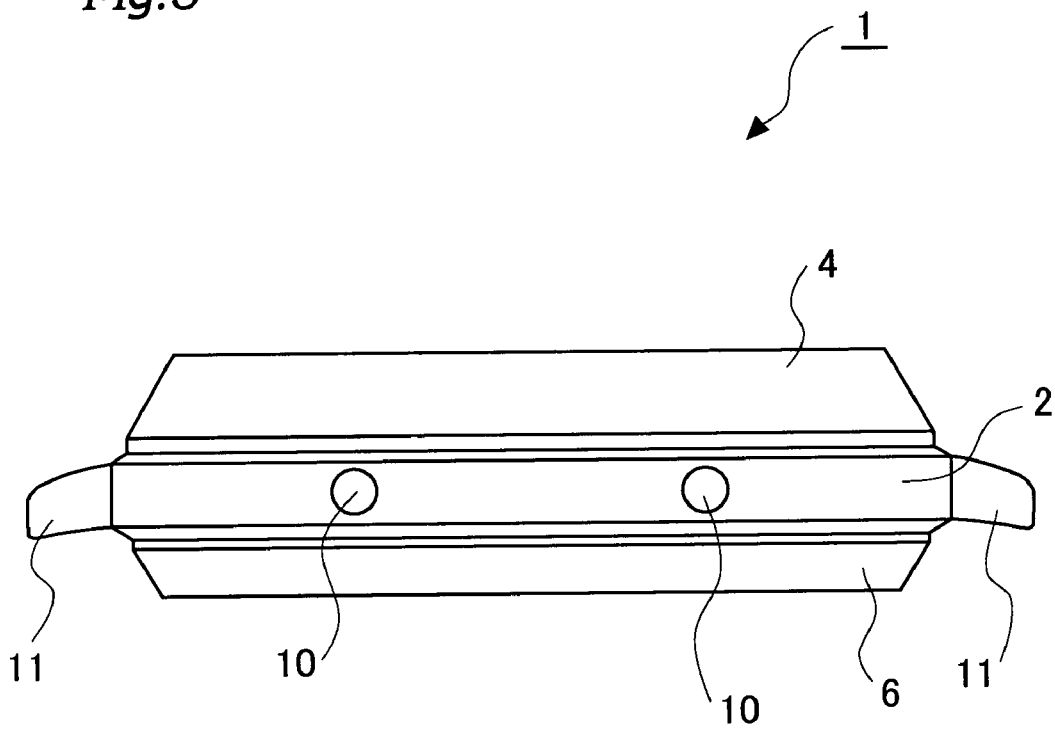
FIG. 3 is a side view showing a construction of a metal radio wave wristwatch case in accordance with the present invention.
Figure 4:
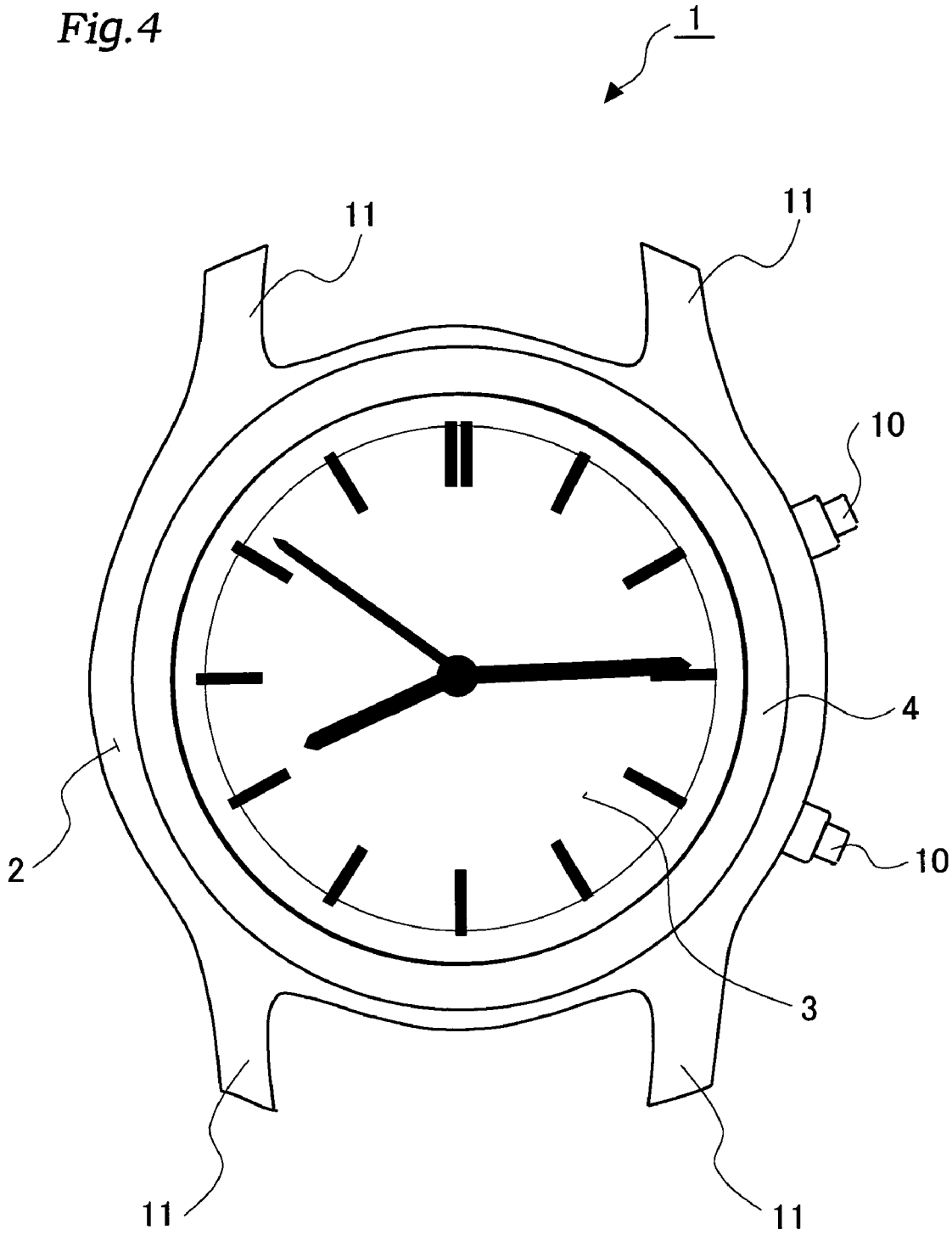
FIG. 4 is a plan view showing a construction of a metal radio wave wristwatch case in accordance with the present invention.

FIG. 2 is a sectional view showing a construction of a metal radio wave wristwatch case in accordance with an embodiment of the present invention, FIG. 3 is a side view showing the same, and FIG. 4 is a plan view showing the same.

As shown in these figures, a radio wave wristwatch 1 in accordance with the present invention has a wristwatch case constructed by integrally combining three elements in a lapped manner: the three elements are, a metal annular base 2 for shaping a case contour, a metal annular window frame 4 positioned on the surface side of the metal annular base 2 to fringe a transparent window plate 3, and a metal annular back cover frame 6 positioned on the back surface side of the metal annular base 2 to fringe a nonmetal back cover plate 5.

The metal annular base 2 shaping a case contour has a purpose for maintaining the strength of the wristwatch case, and also has a function of holding operating pushbuttons 10, 10 penetrating the annular base 2. At appropriate places of the outer periphery of the annular base 2, a pair of brackets 11, 11 for supporting a wristwatch band are formed integrally. As a material of the metal annular base 2, a nonmagnetic or feebly magnetic metal having relatively high radio wave permeability is preferable. As such metal, SUS, Ti, Bs, Al, Ti alloy, Al alloy, etc. can be given. In the example shown in the figures, a material of SUS316L with a thickness of 3.0 mm is used. Also, the annular base 2 has a circular ring shape, and the inside diameter thereof is about 32 mm. Further, when the height D2 of a movement 9 is about 6 mm, the height D1 of the annular base 2 is about 4 mm. That is to say, the dimensional relationship is determined so that the height D1 of the annular base 2 is smaller than the height D2 of the movement 9 (D1<D2). According to the studies conducted earnestly by the inventors, when the height D2 of the movement 9 with a built-in antenna was 5 to 7 mm, a good result was obtained when the height D1 of the annular base 2 was set about 1 to 3 mm (preferably about 1.5 to 2.5 mm) smaller than the height D2 of the movement 9. The movement with a built-in antenna used in the example shown in the figures has the same construction as that of a built in radio wave wristwatches MJW-100, 200, 300 etc. previously released by Maruman Corporation Ltd.

Such dimensional relationship greatly overturns the conventional theory of wristwatch case. The reason for this is as described below. The conventional theory of the person skilled in the art in the watch industry has been that, the inherent function of the annular base 2 is to surround the whole circumference of the movement 9 to protect the movement 9 from mechanical shock etc., therefore, the height D1 of the annular base 2, in other words, the depth of the wristwatch case must be large enough to completely contain the movement 9.

As a material of the metal annular window frame (bezel) 4 for fringing the transparent window plate 3, a nonmagnetic or feebly magnetic metal with relatively high radio wave permeability is preferably used. As such metal, SUS, Ti, Bs, Al, Ti alloy, Al alloy, etc. can be given. In the example shown in the figures, a material of SUS316L with a thickness of about 2.0 mm is used. As a material of the transparent window plate 3, glass or plastics can be selected arbitrarily.

As a material of the metal annular back cover frame 6 for fringing the nonmetal back cover plate 5, a nonmagnetic or feebly magnetic metal with relatively high radio wave permeability is preferably used. As such metal, SUS, Ti, Bs, Al, Ti alloy, Al alloy, etc. can be given. In the example shown in the figures, a material of SUS316L with a thickness of about 2.0 mm is used. As a material of the nonmetal back cover plate 5, glass or plastics can be selected arbitrarily. Also, a colored film having, for example, metal color or black color is formed on the inside surface of the nonmetal back cover plate 5 to provide a sense of luxury in appearance.

Inside the wristwatch case, a nonmetal dial plate 7 is disposed so as to face the transparent window plate 3. Also, the movement 9 with a built-in antenna, necessary to function as a radio wave wristwatch, is contained in a space 8 between the nonmetal dial plate 7 and the nonmetal back cover plate 5.

As a material of the nonmetal dial plate 7, glass, plastics, or the like can be selected arbitrarily. Also, in the example shown in the figures, the movement 9 with a built-in antenna has a disk shape with a height D2 of about 6 mm and an outside diameter of about 25 mm.

More specifically, this movement has a housing shaped as a circular plate, made of relatively thin plastic. A portion of the circumference of this housing is cut straight, and a ferrite bar antenna, which is a rod-shaped longwave antenna, is disposed therein. This ferrite bar antenna is disposed in the tangential direction with respect to the housing having circular plate shape.

Figure 7:
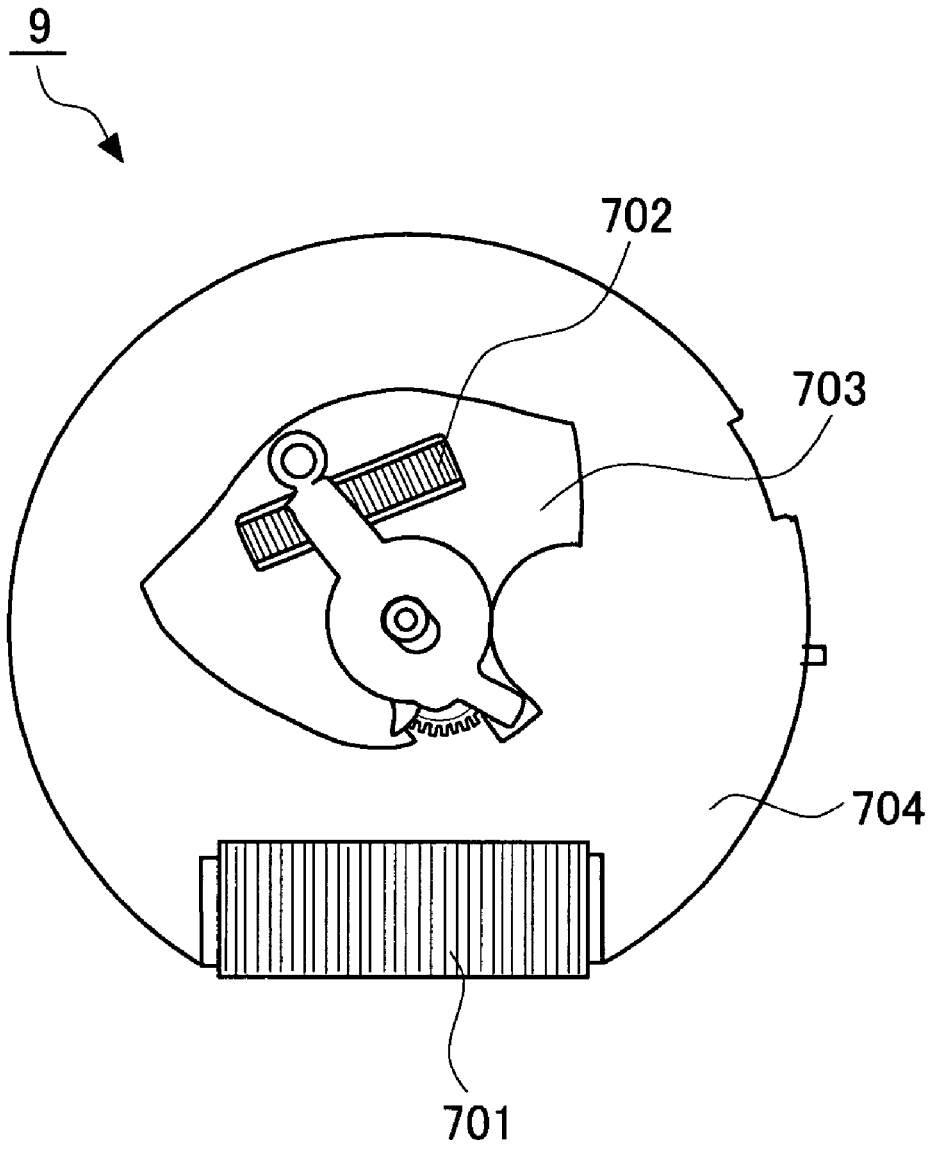
FIG. 7 is a view of a movement with a built-in antenna, viewed from the upper face thereof (dial plate side)
Figure 8:
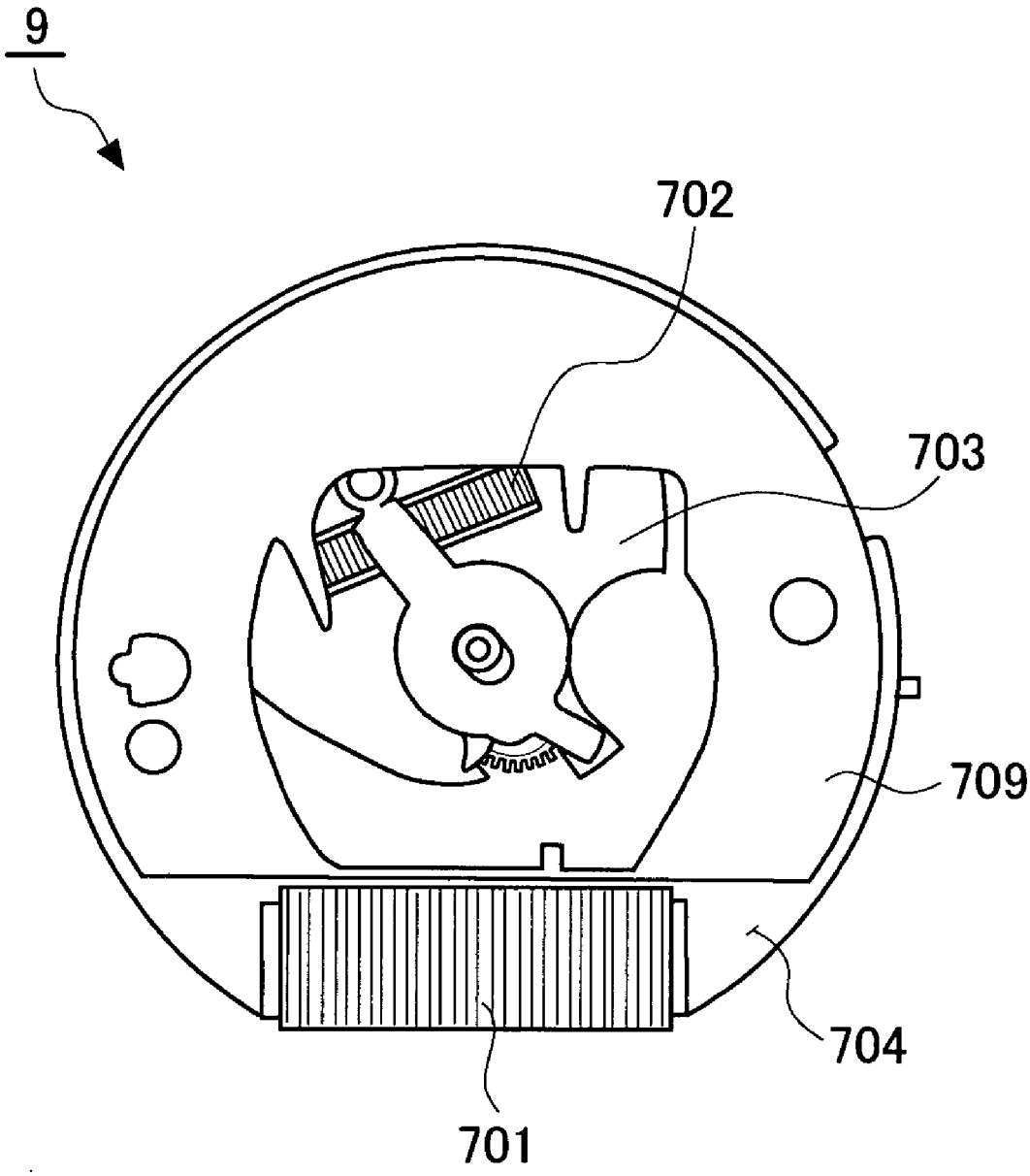
FIG. 8 is a view showing a state in which a shield plate is lapped on a movement with a built-in antenna, viewed from the upper face thereof (dial plate side)
Figure 9:
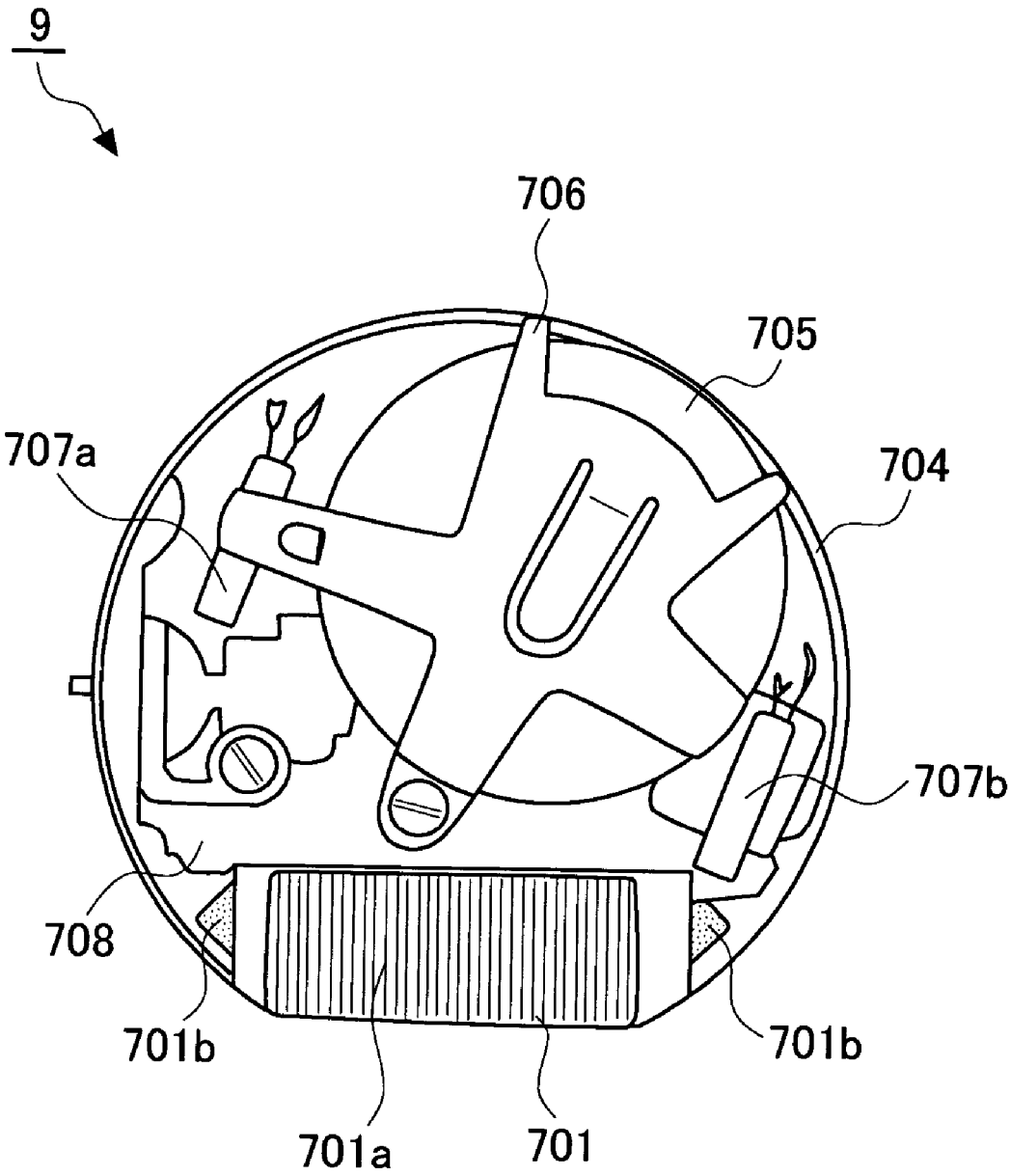
FIG. 9 is a view of a movement with a built-in antenna, viewed from the lower face thereof (back cover side)
Figure 10:
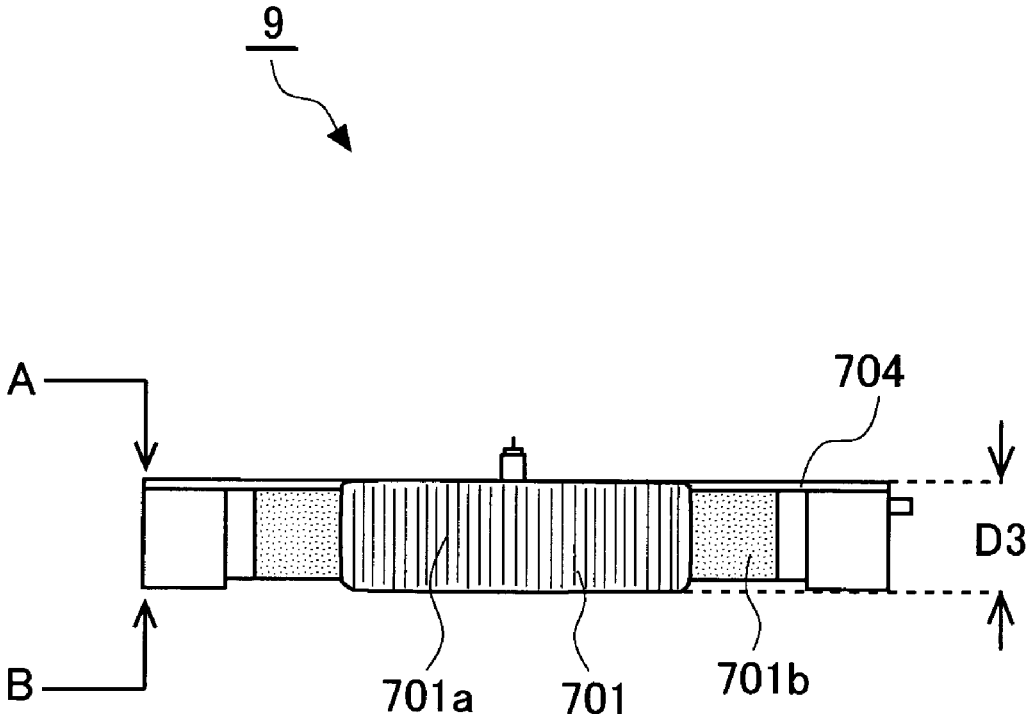
FIG. 10 is a view of a movement with a built-in antenna, viewed from the side thereof.

FIGS. 7 to 10 show one example of a construction of the movement 9 with a built-in antenna used in the radio wave wristwatch 1 in accordance with the present invention. FIGS. 7 and 8 are views of the movement 9 with a built-in antenna, viewed from the upper face thereof (dial plate side), FIG. 9 is a plan view of the movement 9 with a built-in antenna, viewed from the lower face thereof (back cover side), and FIG. 10 is a view of the movement 9 with a built-in antenna, viewed from the side thereof.

A ferrite bar antenna 701 is disposed in the tangential direction near the outer periphery of a housing 704 so that both ends thereof are held by the housing 704. Here, three faces of the antenna 701, the upper face, the lower face, and the side face on the outer periphery side are exposed to the outside from the housing 704. Reference character 701*a* denotes a coil, and 701*b* denotes a ferrite bar constituting an antenna core. The lower face (back cover side) of the circular plate shaped plastic housing 704 is open, and a motor coil 702, a gearbox 703, a battery 705, quartz oscillators 707*a* and 707*b*, a printed circuit board (PCB) 708, and the like are contained in the housing 704. Of these elements, the battery 705 is fixed to a battery holder 706. Also, on the upper face (dial plate side) of the housing 704, a thin shield plate 709 made of stainless steel for shielding high-frequency noise generated from the motor coil 702 is disposed therein. FIG. 10 is a view of the movement 9 with a built-in antenna, viewed from the side thereof (in the direction of six o'clock). This figure reveals that the height D2 of the movement 9 with a built-in antenna is approximately equal to the thickness D3 of the antenna 701.

Returning to FIG. 2, the metal annular window frame 4 has an extension 4*a* extending downward appropriately toward the metal annular base 2 along the whole circumference on the lower face of the metal annular window frame 4. In the example shown in the figure, the extension 4*a* has a length of about 1 mm. Also, the extension 4*a* has a thickness of about 2 mm.

The metal annular back cover frame 6 has an extension 6*a* extending upward appropriately toward the metal annular base 2 along the whole circumference on the upper face of the metal annular back cover frame 6. In the example shown in the figure, the extension 6*a* has a length of about 1 mm. Also, the extension 6*a* has a thickness of about 2 mm.

On the other hand, the height D1 of the metal annular base 2 is decreased by an amount of the extension 4*a* and the extension 6*a* so that the height of the case as a whole is kept unchanged as compared with the height of the conventional case.

Thereby, inside the wristwatch case, the outer periphery of the movement 9 with a built-in antenna disposed between the nonmetal dial plate 7 and the nonmetal back cover plate 5 is surrounded so that the region is divided vertically into three regions, by the metal annular base 2, the lower extension 4*a* of the metal annular window frame 4, and the upper extension 6*a* of the metal annular back cover frame 6.

Figure 6:
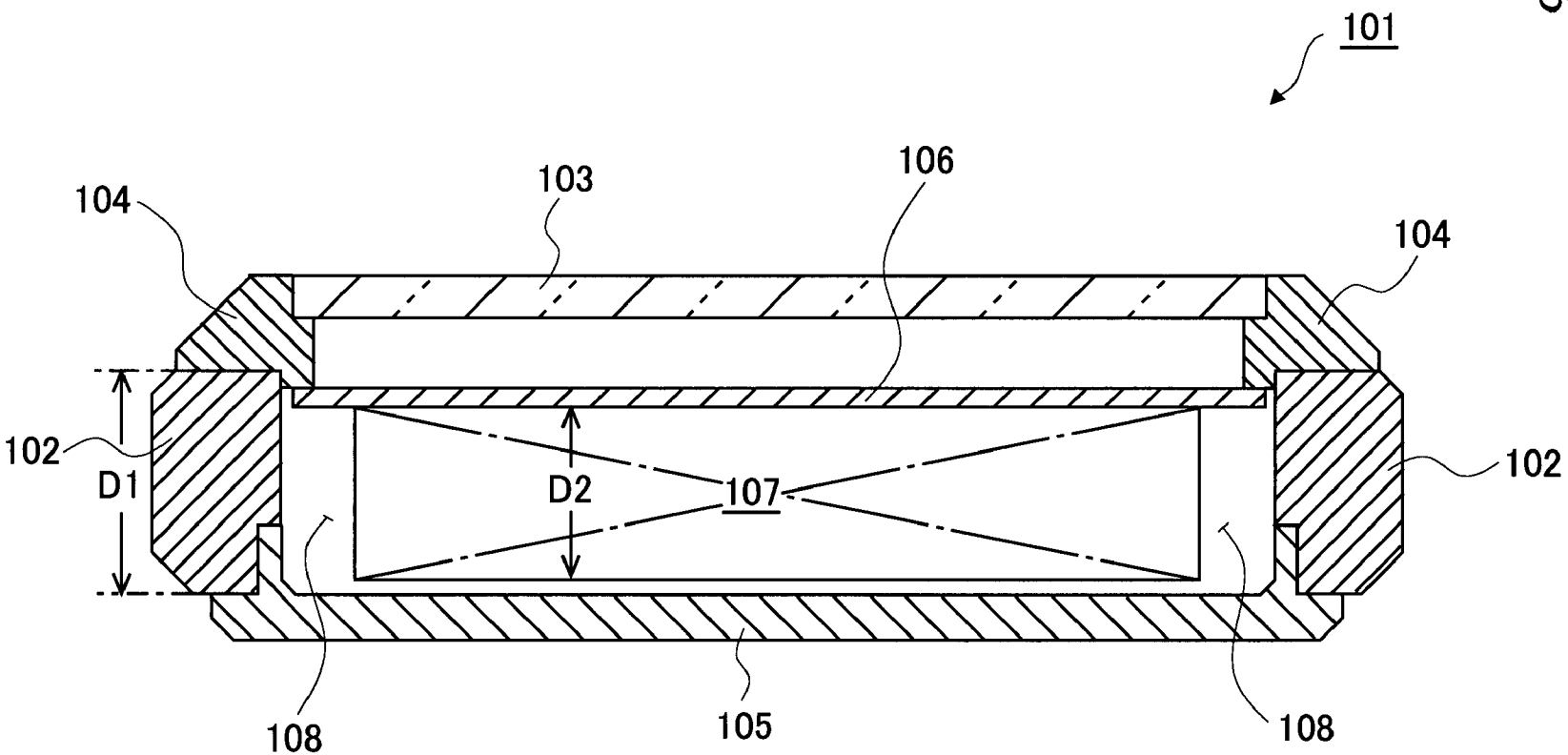
FIG. 6 is a sectional view showing a construction of an ordinary metal wristwatch case.

Herein, the phrase "surrounded so that the region is divided vertically into three regions" means that although conventionally, the whole outer periphery of the movement has been surrounded uniformly without a gap by the metal annular base 102 as shown in FIG. 6, in the present invention as shown in FIG. 2, a portion surrounded by the metal annular base 2, a portion surrounded by the lower extension 4*a* of the metal annular window frame 4, and a portion surrounded by the upper extension 6*a* of the metal annular back cover frame 6 are provided.

More specifically, a middle wide region of the outer periphery of the movement 9 is surrounded by the metal annular base 2, an upper narrow region thereof is surrounded by the lower extension 4*a* of the metal annular window frame 4, and a lower narrow region thereof is surrounded by the upper extension 6*a* of the metal annular back cover frame 6.

Herein, the required thicknesses are compared regarding the metal annular base 2 shaping the case contour, the lower extension 4*a* of the metal annular window frame 4 positioned on the surface side of the metal annular base 2, and the upper extension 6*a* of the metal annular back cover frame 6 positioned on the back surface side thereof. It is difficult to greatly decrease the thickness of the metal annular base 2 because the metal annular base 2 maintains the strength of wristwatch case. Whereas, the thicknesses of the lower extension 4*a* of the metal annular window frame 4 and the upper extension 6*a* of the metal annular back cover frame 6 can be decreased considerably because these extensions 4*a* and 6*a* are not required to have such high strength. Therefore, the thicknesses of these extensions 4*a* and 6*a* are made smaller than the thickness of the annular base 2, by which the radio wave permeability as the whole peripheral side of the space 8 containing the movement 9 is improved, and thus high enough radio wave time signal reception sensitivity to operate the radio wave wristwatch properly can be achieved.

Although the extensions 4*a* and 6*a* are projected from both of the metal annular window frame 4 and the metal annular back cover frame 6 in the above-described embodiment, in the present invention, an extension may be projected from either one of the metal annular window frame 4 or the metal annular back cover frame 6.

Specifically, the following three surrounding embodiments can be thought out according to the configuration of the extensions according to the present invention.

Figure 1:
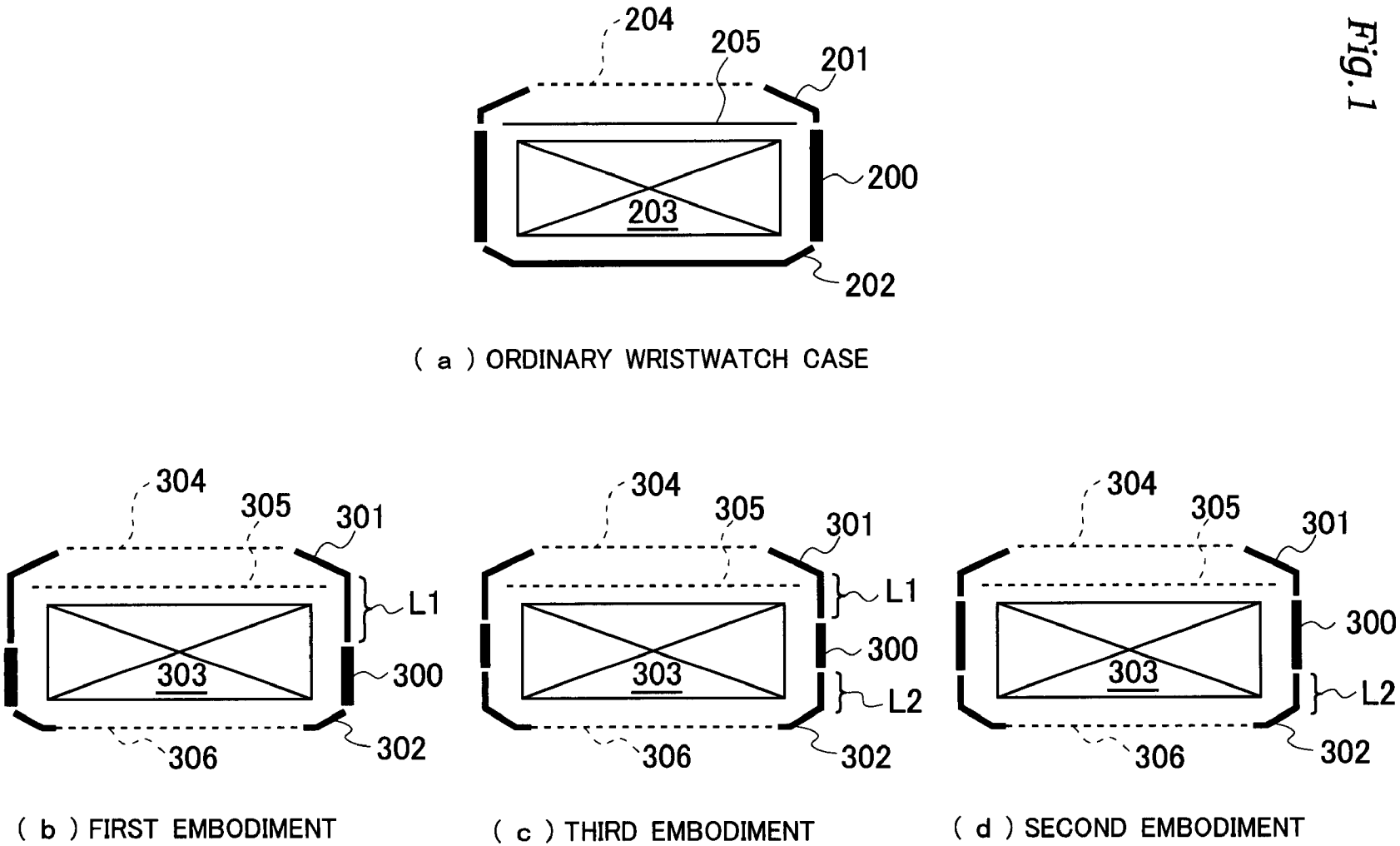
FIG. 1 is a schematic view showing a feature of the present invention.

A first embodiment is a case where only the metal annular window frame 4 is extended downward to form the lower extension 4*a*. If the height of the whole case remains unchanged, the height of the metal annular base 2 would decrease accordingly. In this case, a lower wide region of the outer periphery of the movement 9 is surrounded by the metal annular base 2, and an upper narrow region thereof is surrounded by the lower extension 4*a* of the metal annular window frame 4 (see FIG. 1(*b*)).

A second embodiment is a case where only the metal annular back cover frame 6 is extended upward to form the upper extension 6*a*. If the height of the whole case remains unchanged, the height of the metal annular base 2 would decrease accordingly. In this case, an upper wide region of the outer periphery of the movement 9 is surrounded by the metal annular base 2, and a lower narrow region thereof is surrounded by the upper extension 6*a* of the metal annular back cover frame 6 (see FIG. 1(*d*)).

A third embodiment is a case where not only the metal annular window frame 4 is extended downward to form the lower extension 4*a*, but also the metal annular back cover frame 6 is extended upward to form the upper extension 6*a*. If the height of the whole case remains unchanged, the height of the metal annular base 2 would decrease accordingly. In this case, a middle wide region of the outer periphery of the movement 9 is surrounded by the metal annular base 2, an upper narrow region thereof is surrounded by the lower extension 4*a* of the metal annular window frame, and a lower narrow region thereof is surrounded by the upper extension 6*a* of the metal annular back cover frame (see FIG. 1(*c*)).

Next, the effects of the radio wave wristwatch in accordance with the present invention will be verified using an embodiment of a radio wave wristwatch in accordance with the present invention and comparative examples of some radio wave wristwatches.

[Embodiment of a Radio Wave Wristwatch in Accordance with the Present Invention]

On the basis of the cross-sectional construction shown in FIG. 2, SUS316L was used as the case (the general term of annular base in the industry) 2, the bezel (the general term of annular window frame in the industry) 4, and the back cover frame 6. The height D1 of the case 2 was set at 4 mm, and the height D2 of the movement 9 was set at 6 mm. As the back cover plate 5, a glass plate was used. The bezel 4 was extended 1 mm downward to form the lower extension 4*a*. The annular back cover frame 6 was extended 1 mm upward to form the upper extension 6*a*. Considering the maintenance of the strength, the thickness of the case 2 was decreased to 3 mm. As the dial plate 7, a plastic plate or a glass plate was used. As the transparent window plate 3, a glass plate was used. The thicknesses of the lower extension 4*a* and the upper extension 6*a* each were set at 2 mm.

COMPARATIVE EXAMPLE 1

Comparative example 1 is a case for an ordinary metal wristwatch (not radio wave watch) in which a movement with a built-in antenna is contained, and glass is used as the dial plate 106. On the basis of the cross-sectional construction shown in FIG. 6, SUS304 was used as the case 102, the bezel 104, and the back cover 105. As the case 102, the conventional case was used as it was. Therefore, the height D1 of the case 102 was still larger than the height D2 of the movement 107 (D1>D2). As the dial plate 106, a plastic plate or a glass plate was used. As the transparent window plate 103, a glass plate was used.

COMPARATIVE EXAMPLE 2

Comparative example 2 is an ordinary metal wristwatch case in which a movement with a built-in antenna is contained, a plastic plate or a glass plate is used as the dial plate 106, and further, glass is used as the back cover plate 105. On the basis of the cross-sectional construction shown in FIG. 6, SUS316L was used as the case 102, the bezel 104, and the annular back cover frame (see reference numeral 6 in FIG. 2). As the case 102, the conventional case was used as it was. Therefore, the height D1 of the case 102 was still larger than the height D2 of the movement 107 (D1>D2). As the dial plate 106, a plastic plate or a glass plate was used. As the transparent window plate 103, a glass plate was used. As the back cover plate (see reference numeral 5 in FIG. 2), a glass plate was used.

[Test Method]

Figure 5:
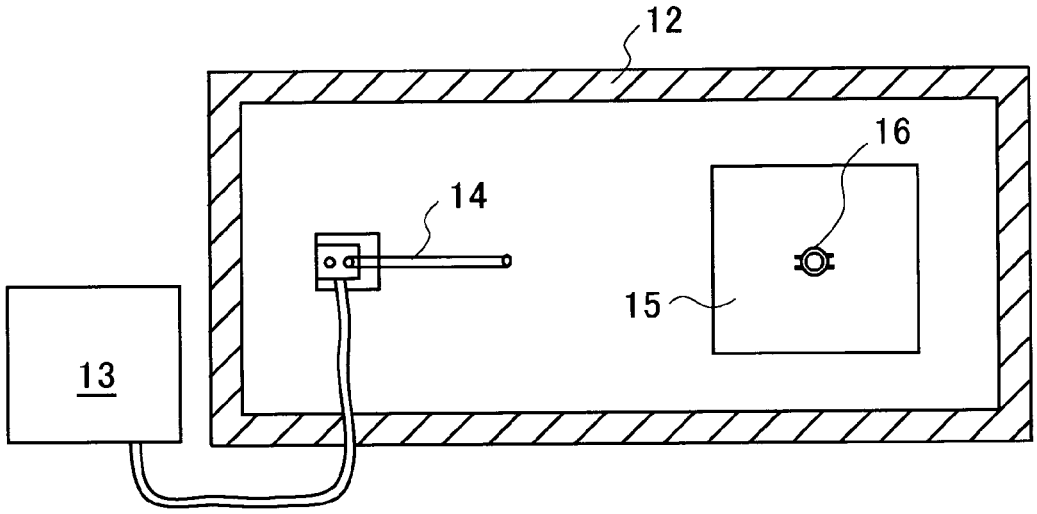
FIG. 5 is an explanatory view showing a configuration of an apparatus for conducting a reception condition test of the metal radio wave wristwatch case in accordance with the present invention.
Figure 5:
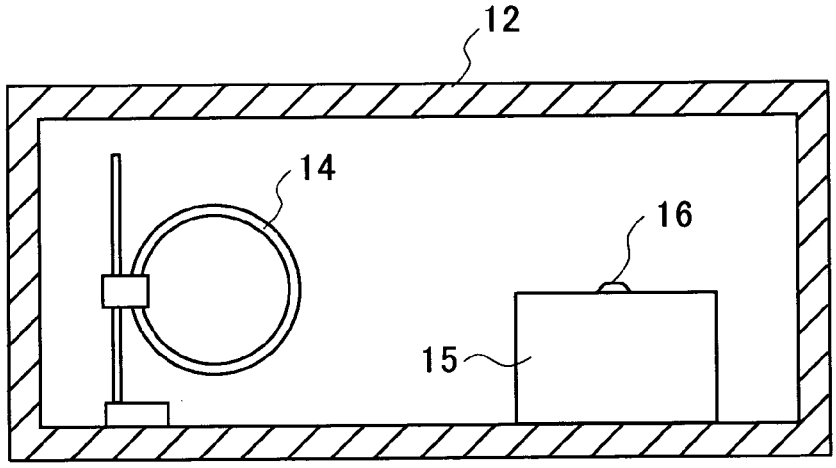

As shown in FIG. 5, each of the above-described wristwatches of the embodiment of the present invention and comparative examples 1 and 2 is placed in a shield box (a container which can shut off all radio waves from the outside), the field intensity of radio wave time signal of 60 KHz generated by a radio wave time signal generator 13 was altered, and the reception performance was tested by the value of field intensity at the time when the wristwatch of each comparative example received radio wave time signals. FIG. 5(*a*) is a plan view of the interior of the shield box, and FIG. 5(*b*) is an elevation view of the interior thereof. Reference numeral 14 denotes an antenna, 15 denotes a stand on which a test object is placed, and 16 denotes an object to be tested (wristwatch to be tested).

[Test result]

| Object to be tested | Field intensity (dBμV/m) |
|---|---|
| Embodiment | 42 |
| Comparative example 1 | 63 |
| Comparative example 2 | 50 dB and higher |

Herein, a lower value of field intensity indicates higher reception performance (ease of reception).

[Conclusions]

In case of the embodiment, high reception performance was obtained in all regions of assumed reception region, and it was confirmed that the wristwatch of the embodiment can be used as a radio wave wristwatch at a practical and satisfactory level. Since a metal was used as an exterior material, a sense of luxury, being consumer's taste, was sufficiently obtained. In addition, the wristwatch of the embodiment can be manufactured at a lower cost as compared with the wristwatch using a ceramic material etc.

In the case of comparative examples land 2, high reception performance could not be obtained, and it was confirmed that the wristwatches of comparative examples 1 and 2 cannot be used as a radio wave wristwatch at a practical level.

According to the radio wave wristwatch described in the above-described embodiment, a high reception wave intensity can be achieved in the movement, and additionally, an excellent sense of luxury in appearance is provided since the whole circumference of wristwatch is surrounded by metal except for the back cover portion which can not be seen in the worn state. Further, the wristwatch case can be manufactured at a relatively low cost using the same fabrication technology as that of the conventional metal wristwatch case, so the present invention contributes to the widespread use of radio wave wristwatches of this type.

INDUSTRIAL APPLICABILITY

As is apparent from the above description, according to the present invention, the radio wave permeability on the upper, lower, and outer peripheral faces of a movement is improved while the strength and thickness of a metal annular base constituting a case body are kept at a required level. Thereby, a radio wave wristwatch having a metallic appearance similar to that of the ordinary wristwatch can be realized.

The invention claimed is:

1. A radio wave wristwatch comprising:

a wristwatch case constructed by integrally combining three elements in a lapped manner, said three elements being a metal annular base, a metal annular window frame positioned on the surface side of said metal annular base to fringe a transparent window plate, and a metal annular case back cover frame positioned on the back surface side of said metal annular base to fringe a nonmetal back cover plate;

a nonmetal dial plate disposed in said wristwatch case so as to face said transparent window plate; and a movement with a built-in antenna disposed between said nonmetal dial plate and said nonmetal back cover plate, the height of the movement with built-in antenna being approximately equal to the thickness of the antenna; wherein the dimensional relationship between said metal annular base and said movement with a built-in antenna is determined so that the height of said metal annular base is smaller than the height of said movement with a built-in antenna, and the upper and/or lower outer peripheries of said movement with a built-in antenna which project vertically from said metal annular base are surrounded by a lower extension of said metal annular window frame and/or an upper extension of said metal annular back cover frame.

2. The radio wave wristwatch according to claim 1, wherein the material of said metal annular base is a nonmagnetic metal or a feebly magnetic metal.

3. The radio wave wristwatch according to claim 1, wherein the material of said metal annular window frame is a nonmagnetic metal or a feebly magnetic metal.

4. The radio wave wristwatch according to claim 1, wherein the material of said metal annular back cover frame is a nonmagnetic metal or a feebly magnetic metal.

5. The radio wave wristwatch according to claim 1, wherein the material of said nonmetal dial plate is plastics or glass.

6. The radio wave wristwatch according to claim 1, wherein the material of said nonmetal back cover plate is plastics or glass.

7. The radio wave wristwatch according to claim 1, wherein the thickness of said metal annular base is in the range of 2.0 to 3.0 mm, and the thickness of the lower extension of said metal annular window frame and the upper extension of said metal annular back cover are 0.5 mm or more smaller than the thickness of said metal annular base.

8. The radio wave wristwatch according to claim 1, wherein a film having metal color or a painted film of various types is formed on the inside surface of said nonmetalback cover plate.

9. The radio wave wristwatch according to claim 1, wherein the material of said transparent window plate is plastics or glass.

* * * * *